United States Patent [19]

Hathaway

[11] 4,148,405

[45] Apr. 10, 1979

[54] SOLID FEEDER AND METHOD

[75] Inventor: Thomas J. Hathaway, Belle Meade, N.J.

[73] Assignee: The United States of America as represented by the United States Department of Energy, Washington, D.C.

[21] Appl. No.: 856,367

[22] Filed: Dec. 1, 1977

[51] Int. Cl.[2] ..... C10J 3/30

[52] U.S. Cl. ..... 414/207; 414/220; 414/786

[58] Field of Search ..... 214/17 B, 17 C, 18 R, 214/31, 152, 35; 48/86 R

[56] References Cited

U.S. PATENT DOCUMENTS

| | | | |
|---|---|---|---|
| 1,875,921 | 9/1932 | Grant et al. | 214/31 X |
| 3,633,770 | 1/1972 | Howard | 214/17 B |

*Primary Examiner*—Robert G. Sheridan

*Attorney, Agent, or Firm*—Dean E. Carlson; Leonard Belkin

[57] ABSTRACT

This invention provides a housing containing a rotatable coal bucket that is sealed at its ends in the housing with a reciprocal plunger that is sealed in the bucket at one end and has an opposite cone-shaped end that wedges up against a closed end of the bucket, and a method for feeding dry, variable size coal from an ambient atmosphere at low pressure into a high temperature, high pressure reactor between the seals for producing fuel gas substantially without losing any high pressure gas from the reactor or excessively wearing the seals. To this end, the piston biases the plunger back and forth for loading and unloading the bucket with coal along an axis that is separated from the seals, the bucket is rotated to unload the coal into the reactor so as to fill the bucket with trapped high pressure gas from the reactor while preventing the gas from escaping therefrom, and then the cone-shaped plunger end is wedged into mating engagement with the closed end of the bucket to displace this high pressure bucket gas by expelling it back into the reactor whereby the bucket can be re-rotated for filling it with coal again substantially without losing any of the high pressure gas or excessively wearing the seals.

11 Claims, 4 Drawing Figures

LOAD MODE

DELIVERY MODE

CLOSED MODE

RELOAD MODE

SOLID FEEDER AND METHOD

BACKGROUND OF THE INVENTION

This invention was made during the course of, or under a contract with the U.S. Energy Research and Development Administration.

In the field of coal gasification, it is desirable to load coal from a low pressure ambient atmosphere to a high temperature reactor at pressures up to 1500 psig or more for producing fuel gas from the coal. One system for loading the coal into the reactor heretofore employed a slurry feeder. However, this system required slurrys, which were difficult and dirty to handle; they also limited the size of the coal used to a substantially uniform small diameter. On the other hand, the dry systems used heretofore, required hot gas valves and/or lock hoppers from which the high pressure gas from the reactor was allowed to escape. The latter resulted in substantial power losses from the reactor. Moreover, the typical lock hopper seals and hot gas valves that were required therewith, were expensive, subject to rapid wear, or were otherwise troublesome.

SUMMARY OF THE INVENTION

This invention eliminates the problems and shortcomings of the prior art by employing a longitudinally extending, rotatable coal bucket that is sealed at its ends in a housing and loaded and unloaded between the seals while trapping high pressure gas from the reactor in the bucket between the seals, and by wedging a cone-shaped plunger end against a closed end of the bucket to displace the trapped high pressure bucket gas by expelling it back into the reactor from between the seals for conserving the gas power in the reactor, and for preventing wear on the seals. To this end, this invention provides a sleeve forming a longitudinally extending housing means, a rotable bucket having its ends sealed in the housing and having a reciprocal plunger forming a cone-shaped end that mates with the closed end of the bucket for displacing the high pressure gas trapped in the bucket back into the reactor from between the seals, and a non-rotating piston in the sleeve for biasing the plunger back and forth longitudinally while the bucket and housing are sealed against the release of the high pressure gas from the reactor.

More particularly, in one embodiment the process of this invention involves the steps of loading a longitudinally extending bucket with coal having sealed ends in a housing, a closed end, an open end and an orifice, the coal being loaded through the orifice between the seals to displace ambient low pressure gas from the bucket during a loading mode, rotating the bucket for unloading the coal into the reactor from between the seals during a delivery mode so that the coal is dropped by gravity through the orifice and replaced by high pressure gas from the reactor but any other leakage therefrom is substantially prevented; displacing the high pressure gas from the bucket by biasing a plunger having a cone-shaped end through the open end of the bucket into mating engagement with the closed end of the bucket to expel the displaced high pressure gas back into the reactor during the closed mode, to center the plunger in the bucket, and to crush any residual coal therein; and rotating the bucket for filling the bucket with ambient low pressure gas during a reloading mode substantially without letting the high pressure gas escape to the ambient during said filling, loading, unloading and displacing so as to conserve the high pressure gas power in the reactor during all said modes. With the proper selection of elements and their operation, as described in more detail hereinafter, the desired loading and conservation are achieved.

OBJECTS OF THE INVENTION

It is an object of this invention, therefore, to feed coal from an ambient atmosphere at low pressure into a reactor for producing fuel gas at high pressure;

It is another object to feed dry and/or variable-size coal to a high pressure reactor substantially without causing excessive wear on any sealing surfaces;

It is still further object to provide a rotatable bucket from which coal is displaced by a high pressure gas from a container having means for displacing the gas to expel it back into the container for conserving the gas power in the container.

The above and further novel features and objects of this invention will appear more fully from the following detailed description of one embodiment when the same is read in connection with the accompanying drawings, and the novel features will be particularly pointed out in the appended claims. It is to be expressly understood, however, that the drawings are not a definition of the invention but are for illustration only.

BRIEF DESCRIPTION OF THE DRAWINGS

Referring to the drawings in which like elements are referenced alike.

DESCRIPTION OF THE PREFERRED EMBODIMENT

This invention is useful in introducing substances from a low temperature ambient atmosphere at low pressure into a high pressure, high temperature container system. To this end, this invention is particularly useful for introducing coal from a hopper at atmospheric pressure into a high temperature coal gasifier at pressures up to 1500 psig or more. It will be understood, however, that this invention is useful for a wide variety of applications requiring the loading of solids from a low pressure to a high pressure ambient in a simple, efficient and effective manner.

Figure 1:
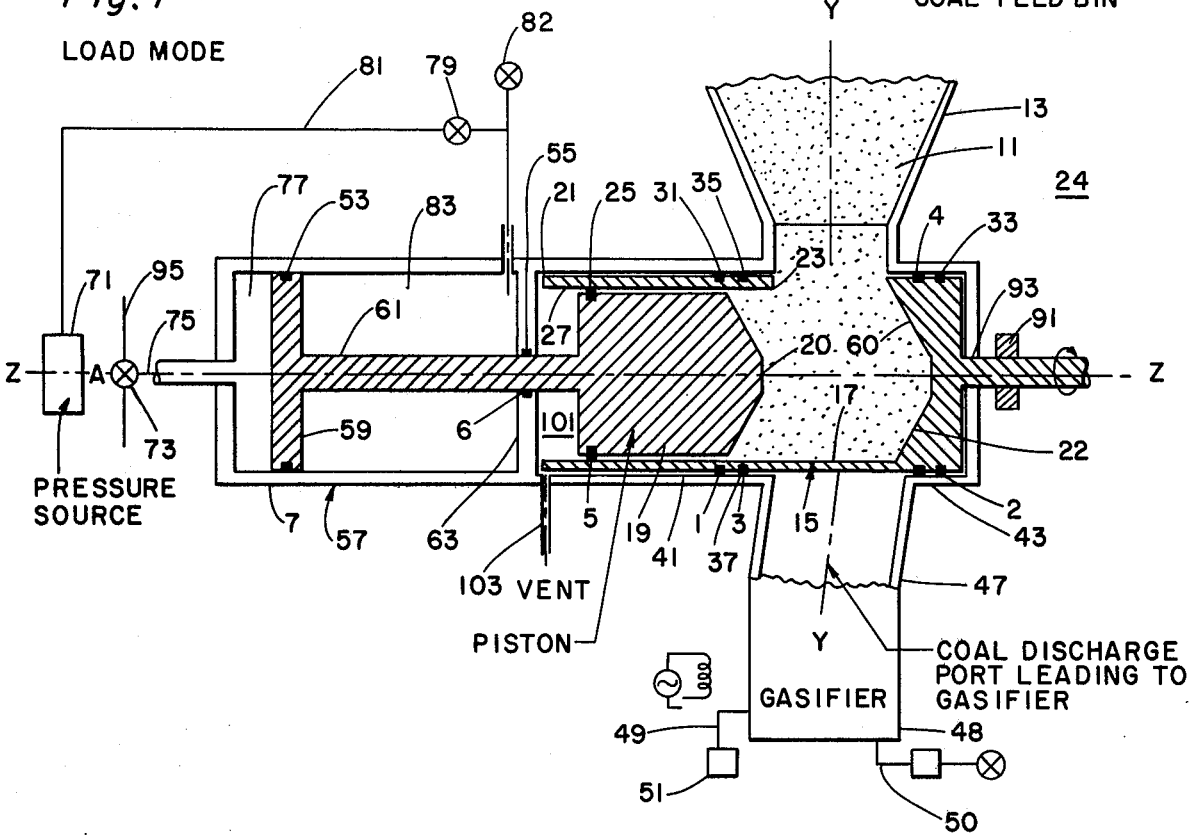
FIG. 1 is a partial cross-section of one embodiment of the dry coal feeder of this invention illustrating the loading mode thereof.

Referring to FIG. 1, coal 11 from coal bin 13 fills lock 15 formed by a scoop-shaped shoe 17 having a non-rotating plunger 19 forming a truncated cone-shaped end 20 that is longitudinally wedged into the open end 21 thereof to form a rotatable coal bucket 22 in which only the plunger reciprocates selectively to close and open the rotatable orifice 23 from the low pressure ambient atmosphere 24 while preventing leakage of gas across the lock 15. To this end, the plunger has a circular seal 25 in sealing contact with the inside surface 27 of the bucket 22, and the bucket has circular seals 31, 33, 35 and 37 on its outside diameter in sealing contact with the inside surface 41 of a cylindrical housing 43 forming coal feed bin 13 and an outlet port 47 connected to a high pressure, high temperature gasifier-reactor 48 having suitable inlets 49, outlets 50, and gas sources 51. By selectively reciprocating the non-rotating plunger 19 and selectively rotating the non-reciprocating coal bucket 22, the bucket orifice 23 first selectively rotates to communicate the lock 15 with the low pressure ambient through coal bin 13, while the lock is closed from communication with the high pressure gas in gasifier-reactor 48, and then selectively communicates the lock 15 with the gasifier while selectively blocking communication of the lock with the low pressure ambient atmosphere.

During rotation of the shoe and/or reciprocation of the plunger, the seals substantially block any gas from leaking from the gasifier-reactor to the ambient 24 through the lock 15. To this end, seals 25, 31 and 33 are positive circular seals centered on the z—z axis, and seals 35 and 37 are circular seals centered on the y—y axis at right angles to the z—z axis for maintaining the desired pressure differential across the housing and the bucket means from the gasifier-reactor to the low pressure ambient and across the lock, discharge port and the single coal receiving and discharge port in the bucket means. The annular seals 31 and 33 are in parallel verticle planes and these seals are interposed between the sealing surface 41 of the cylindrical housing means and the bucket means on the opposite sides of the coal feed bin and the coal discharge port, as well as the single coal receiving and discharging orifice 23 in the bucket means. The annular second seals 35 and 37 are in parallel horizontal planes and these seals are interposed between the inside of the housing and the outside of the bucket means so as to be arranged around the open end at the top of the coal discharge port 47 and the open end of the bottom of the coal feed bin 13 respectively for substantially preventing verticle gas flow across the bucket from the coal feed bin to the coal discharge port.

As will be understood in more detail hereinafter, none of the seals are in the path of the coal as it is transported from the coal bin to the reactor, so the seals are substantially not eroded by the moving coal and the seals are substantially free from abrasion by any residual coal during the loading operation. Additionally, the plunger 19 forms a truncated, cone-shaped punch 20 in cross-section whose cameo is wedged into a rigid locking engagement with the closed end of the bucket, whose intaglio forms a mating matrix for the punch 20.

Additional circular seals 53 and 55 are provided for means 57 for biasing the plunger 19 back and forth in the bucket 22. Seal 53 is interposed between the outside of piston 59 and the sealing surface 41 of the cylindrical housing 43, and the seal 55 is interposed between the connecting rod 61 for the piston 59 and a partition 63 between the plunger 19 and the piston 59.

A source 71 of fluid under pressure connects through two-way valve 73 and line 75 with chamber 77 to bias the piston 59 and plunger 19 in one direction along the z—z axis. The same source also connects through valve 79 and line 81 having a selectively closed vent valve 82 with chamber 83 to move the piston 59 and plunger 19 in the opposite direction along the z—z axis. This reciprocation has the advantage that the plunger moves away from the coal bin to open the lock 15 for receiving the coal 11 from coal bin 13. Later, after the bucket 22 is rotated to dump the coal into the gasifier-reactor, the lock 15 fills with a corresponding volume of high pressure gas that is trapped in the lock 15. Then, the plunger 19 is biased back toward the coal bin and the coal discharge port to expel this trapped volume of high pressure gas back into the reactor so that there is substantially no loss of high pressure gas every time the lock is filled with coal.

The truncated cone-shaped cross-sectional end 20 of plunger 19 mates with and wedges into sealing contact with the correspondingly shaped intaglio of recess 60 in the closed end of bucket 22. This wedging action centers the plunger along the z—z axis and crushes any coal particles that may be lodged between the plunger and the closed end of the bucket so as to purge the same. Also, the wedge shaped recess deflects the coal away from the sealing surface 41 between the bucket 22 and the cylindrical housing 43, and it also substantially completely expels all the trapped gas back into reactor 48, while preventing any high pressure gas from entering the lock during the time the lock is being rotated.

Handle 91, which is mounted at the closed end of the bucket 22, rotates the bucket 22 first to line up the orifice 23 with the coal feed bin, and, later, after the coal is loaded into the lock 15, to line up the orifice 23 with the coal discharge port to dump the coal into the gasifier-reactor. Then the handle rotates the bucket back again to line up the orifice 23 with the coal feed bin for the beginning of a new cycle. Bearing 93 permits the bucket to rotate freely in cylindrical housing 43.

In one sequence, which is illustrated in FIGS. 1–4, the lock is alternately, selectively, opened and closed from either the low pressure ambient or the high pressure gasifier-reactor respectively to prevent the escape of high pressure gas to the ambient atmosphere through the lock.

In FIG. 1, the orifice 23 is lined up with the coal feed bin so that the lock 15 is filled with coal.

Figure 2:
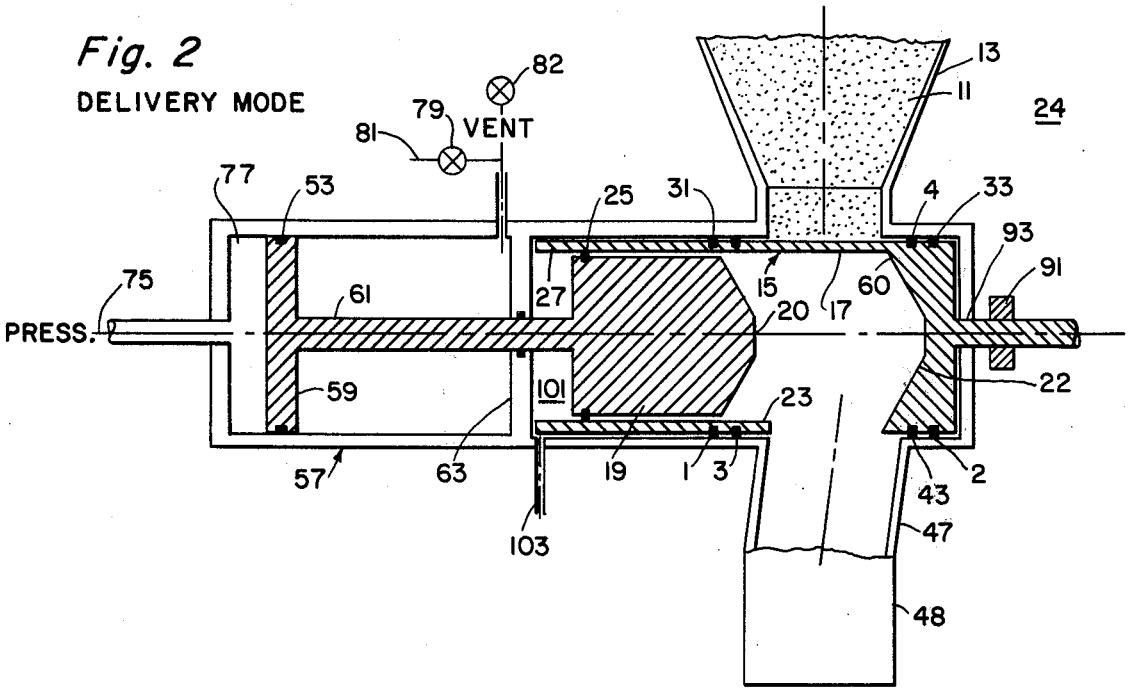
FIG. 2 is another view of the apparatus of FIG. 1 illustrating the delivery mode of this invention.

Then handle 91 rotates the bucket to line up the orifice 23 with the coal discharge port 47. This dumps the coal 11 into the gasifier-reactor so as to displace the coal with a corresponding volume of high pressure gas, which is trapped in lock 15, as illustrated in FIG. 2.

Figure 3:
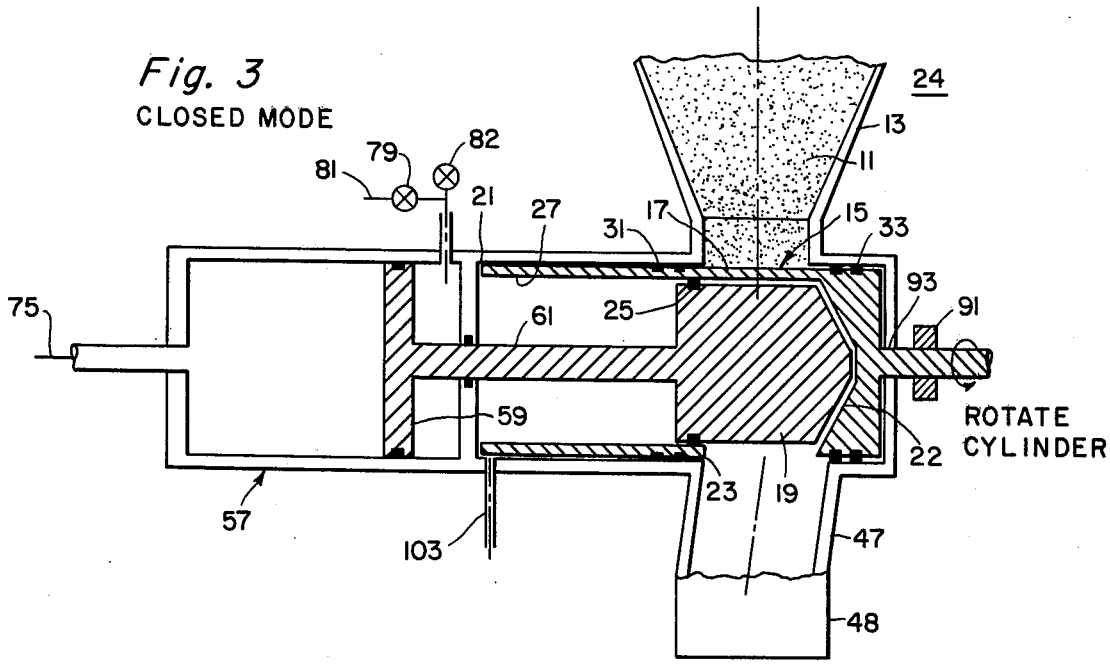
FIG. 3 illustrates the closed mode of the apparatus of FIG. 1.

FIG. 3 illustrates the next step, which biases the piston 59 and plunger 19 to expel the trapped gas volume back into the gasifier-reactor. To this end, valve 79 opens while valve 82 is closed so that fluid source 71 pressurizes chamber 83. The gas in chamber 77 is vented to the atmosphere through vent 95 by suitably positioning two-way valve 73 when the piston moves the plunger away from the coal feed bin.

Figure 4:
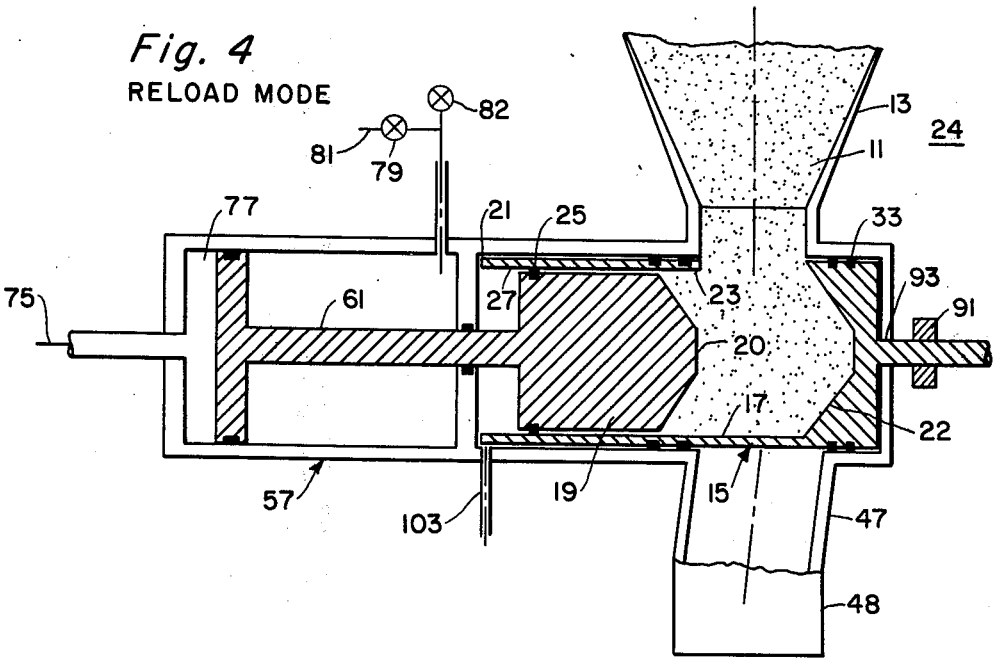
FIG. 4 illustrates the reload mode of the apparatus of FIG. 1.

When the plunger moves in the opposite direction, the gas in chamber 101 is vented to the atmosphere through vent 103, as illustrated in FIG. 4.

In operation, coal 11 is automatically fed through orifice 23 to the lock 15 from the coal feed bin 13 at ambient pressure and temperature by simply rotating the coal bucket to line up the orifice 23 with the coal bin. Then handle 91 rotates the bucket to dump the coal into the gasifier-reactor, which contains hydrogen or another gas at a pressure of up to 1500 psi or more at a temperature of 800° C. or more. This lines up the orifice with the discharge port 47. The coal then is thus dumped into the gasifier-reactor where it forms fuel gas and char that are removed from the bottom of the reactor by conventional means, such as through the valves and lines shown in FIG. 1. Also, the high temperature is produced by conventional heater means, such as the heating element shown in FIG. 1.

After the coal is dumped from the lock 15 to displace the coal with high pressure gas that is trapped in the lock 15, the plunger reduces the volume of lock 15 to expel the trapped gas back into the gasifier-reactor through the orifice 23 and the coal discharge port. Then the coal bucket is rotated to line up the orifice with the coal feed bin, and the plunger is retracted from the lock to increase the volume of the lock 15 for the beginning of a new cycle in which more coal automatically falls by gravity into the lock to fill the same.

This invention has the advantage of efficiently feeding coal into a high-temperature, high-pressure gasifier-reactor substantially without losing any of the high-pressure, high-temperature gas therefrom or abraiding any of the seals thereof. To this end, this invention provides a shoe-shaped coal bucket in a sleeve forming a lock to dump the coal into the gasifier-reactor substantially without abraiding any of the seals thereof. Also, when the coal is dumped it is displaced by high-pressure gas that is trapped in the lock. Then the trapped gas is expelled back into the gasifier-reactor by a plunger that reduces the volume of the lock before it is rotated to receive more coal. After the bucket is rotated to its initial position for the beginning of a new cycle, the plunger is retracted from the lock to increase its volume, and coal automatically fills the lock again at ambient low pressure and temperature substantially without eroding or abraiding the seals and substantially without leaking any high-pressure high-temperature gas out of the gasifier-reactor to the ambient through the lock.

This invention also has the advantage that it provides single malfunction safety protection in case of failure of any single actuation system component. To this end, the coal feed bin is always sealed off from the gasifier.

This invention has the additional advantage that it can feed all types of coal and any size required.

A still further advantage is that the coal is not physically or chemically altered, e.g., crushed, compacted, agglomerated or devolatilized.

What is claimed is:

1. The process of feeding coal from a low pressure ambient atmosphere into a reactor for producing fuel gas at high pressure, comprising the steps of:

a. loading coal in an ambient low pressure atmosphere into a longitudinally extending low pressure gas containing bucket having sealed ends in a housing, a closed end, an open end and an orifice, the coal being loaded in a low pressure ambient atmosphere through the orifice between the seals to displace the low pressure gas from the bucket into the low pressure ambient atmosphere through the orifice during a loading mode;

b. rotating the bucket for unloading the coal through the orifice into the reactor during a delivery mode so that the coal is unloaded through the orifice and replaced by high pressure gas from the reactor that is trapped in the bucket;

c. displacing the trapped high pressure gas from the bucket by biasing a plunger having a cone-shaped punch through the open end of the bucket into mating engagement with the closed end of the bucket to expel the displaced high pressure gas back into the reactor during a closed mode; and d. rotating the bucket for filling the bucket with ambient low pressure gas from the atmosphere through the orifice during a reloading mode substantially without letting the high pressure gas escape to the low pressure ambient atmosphere through the bucket during said filling, loading, unloading and displacing so as to conserve the high pressure gas power in the reactor during all of said modes.

2. The process of claim 1 characterized by a closed mode step during which the high pressure gas is expelled from the unloaded bucket by mechanically reducing the volume of the bucket.

3. The process of claim 2 comprising the step in which the bucket volume containing the high pressure gas is mechanically reduced by biasing a plunger into this volume from which the coal was unloaded while the bucket volume communicates with the reactor and is sealed from the ambient atmosphere to cause the gas to be displaced into the high pressure gas reactor.

4. The process of claim 3 including steps in which a small volume of high pressure gas is allowed to fill the bucket during the unloading, this unloading is followed by a closed mode during a portion of which the small volume of high pressure gas that is allowed to fill the bucket is mechanically displaced by biasing a plunger into the bucket in one direction to reduce its volume and thereby to push the small column of high pressure gas therein back into the high pressure reactor, and during another portion of this closed mode the bucket is closed from both the high pressure reactor and the ambient in preparation for a return to the reloading mode wherein the reactor remains sealed from the ambient.

5. The process of claim 4 including the step in which the plunger is biased back again in the opposite direction during a portion of the closed mode to increase the volume of the bucket for admitting air from the ambient atmosphere, and then coal is admitted by gravity to displace this air during the reloading mode for the beginning of a new cycle in which more coal is delivered to the reactor substantially without losing gas therefrom.

6. The process of feeding coal from a low pressure ambient into a reactor for producing fuel gas at high pressure, comprising the steps of:

a. loading coal into a longitudinally extending, scoop-shaped, coal bucket having opposite ends that are sealed in a housing, an open end, a closed end, a coal feed bin and an orifice for receiving the coal from the bin from between the seals at ambient room pressure for preventing leakage of high pressure gas from the reactor to the ambient atmosphere around, along and through the bucket while the bucket is selectively, cyclically and sequentially positioned along a horizontal axis;

b. cyclically, sequentially rotating the loaded bucket on the horizontal axis to cause the orifice to rotate between the seals into communication with the reactor along a verticle axis for unloading the bucket between the seals by delivering the coal to the high pressure reactor along the verticle axis, and to permit the reactor to displace the unloaded coal with high pressure gas that is trapped between the seals during the delivery mode; and c. selectively biasing a plunger having a cone-shaped punch end into wedging engagement with one end of the bucket for expelling the high pressure trapped gas from the unloaded bucket into the reactor by mechanically displacing the gas from the orifice into the high pressure reactor and crushing any residual coal in the bucket; and d. cyclically, sequentially, rotating the orifice between the seals to communicate the orifice with the coal bin along the verticle axis and then biasing the piston along a horizontal axis to its initial place for loading the bucket again between the seals in a reloading mode substantially without losing gas from the reactor.

7. Apparatus for feeding coal from an ambient at low pressure to a reactor for producing fuel gas at high pressure comprising:

a. cylindrical housing means forming a sleeve having an open ended, low pressure coal feed bin on top of the housing means and an open-ended coal discharge means connected to the reactor at the bottom of the housing means along a verticle first axis at one end of the housing means;

b. a rotatable, scoop-shaped shoe forming an open-ended bucket means having an open end, a closed end, an orifice within the housing means and a handle extending through one end of the housing means from said one end, and the orifice forming a single coal receiving and discharging port along the verticle axis for sequentially alternately receiving coal from the coal feed bin at an ambient low pressure and rotating to spill the coal received through the discharging port at a high pressure so as to receive high pressure gas from the reactor that displaces the unloaded coal;

c. reciprocal plunger means having one end and an end forming a truncated cone in cross-section that is biased in the mouth of the bucket means into wedging engagement with the closed end of the bucket means;

said plunger having at one end a connecting rod along the second axis forming a piston having first and second opposing piston faces normal to the second axis at one end of the second shaft and a first outer piston surface inside the housing means at the opposite end of the second shaft;

said piston being operable to bias the plunger along the horizontal axis for selectively expelling high pressure gas from the bucket back into the reactor through the coal receiving and discharging port;

d. annular first and second sealing means for maintaining a pressure differential across the housing, bucket and plunger means from the coal feed bin to the coal discharge means, so as to trap the high pressure gas that displaces the unloaded coal, comprising first and second circular sealing means in parallel verticle planes interposed between the cylindrical housing means and the bucket means on the opposite sides of the coal feed bin, the coal discharge means, and the orifice in the bucket means for substantially preventing horizontal gas flow along the bucket means from the reactor;

e. annular third and fourth sealing means centered on a vertical axis through the orifice when it is being loaded and unloaded and interposed between the inside of the housing means and the outside of the bucket means around the open end at the top of the coal discharge means and the open end of the bottom of the coal coal feed bin respectively for substantially preventing verticle gas flow across the bucket means from the coal discharge means to the coal feed bin;

f. annular fifth sealing means interposed between the outside of the reciprocal plunger means and the inside of the bucket means for substantially preventing gas flow from the reactor along, around and through the plunger from the coal discharge means to the coal feed bin;

g. sealing means interposed between the outside of the connecting rod and the inside of the housing means for substantially preventing fluid flow along the piston shaft;

h. sealing means interposed between the outer piston surface and the inside of the housing means for forming pressure chambers on opposite faces of the piston for biasing the piston and plunger means forward and away from the sealing means interposed between the outside of the piston shaft and the inside of the housing means;

i. first vent means for venting one face of the piston when the plunger is biased in one direction thereby;

j. second vent means for venting the other face of the piston when the plunger is biased in the opposite direction thereby; and k. means for selectively, alternately sequentially pressurizing the opposite faces of the piston in the sleeve for biasing the plunger back and forth in the bucket means toward the coal discharging port sequentially to decrease the volume of the bucket means for expelling high pressure gas from the bucket into the coal discharge means to prepare the apparatus for a closed mode prior to the rotation and loading of the bucket means, and for selectively alternately, sequentially rotating the bucket means and increasing the volume of the bucket means for receiving air at ambient pressure that can be displaced by coal falling by gravity into the bucket means between and through the numbered sealing means respectively substantially without abrasion thereof and substantially without losing gas from the high pressure reactor means.

8. In apparatus for feeding coal from an ambient at low pressure to a reactor for producing fuel gas at high pressure, the improvement comprising:

a. scoop-shaped bucket means having a closed end, an open end and an orifice that is rotatable, selectively, alternately to receive coal from the ambient and to discharge the coal into the reactor;

b. a plunger forming a cone-shaped punch that reciprocates cyclically through the open end in one direction for selectively allowing the bucket means to receive and dump the coal through the orifice for selectively receiving high pressure gas from the reactor that displaces the coal during the discharge of the coal into the reactor, the movement through the open end displacing the high pressure gas back into the reactor through the orifice, while centering the plunger in the bucket means for selectively, mechanically expelling the high pressure gas into the reactor by moving to decrease the volume of the bucket means; and c. sealing means having annular seals in parallel verticle planes on the opposite sides of the orifice and annular seals in parallel horizontal planes on a verticle axis through the orifice for trapping the high pressure gas in the bucket by substantially preventing gas flow along, around and through the bucket means from the reactor to the ambient during the loading, unloading and rotation of the bucket means and the reciprocation of the plunger for conserving the high pressure gas in the reactor and substantially preventing power losses by the leakage of the gas therefrom while permitting the loading of variable size coal between the verticle seals and through the horizontal seals without slurrying and abrasion at the seals.

9. The apparatus of claim 8 in which the sealing means are located out of the direct path of the coal.

10. The apparatus of claim 8 in which the plunger has means for mechanically biasing the same in the bucket means selectively to reduce and to increase the volume of the bucket means respectively.

11. The apparatus of claim 8 in which the bucket means is a longitudinally extending, cylindrical, scoop-shaped bucket in which the orifice is located along a verticle axis that is rotated to cause the coal to be fed into the reactor, and the punch is reciprocated along a horizontal axis in the bucket means by biasing the plunger through the open end of the bucket against the closed end of the bucket means to crush residual coal particles in the bucket means.

* * * * *